US007066784B2

(12) United States Patent
Peay

(10) Patent No.: US 7,066,784 B2
(45) Date of Patent: Jun. 27, 2006

(54) UNDERGARMENT FOR BODY SHAPING

(76) Inventor: Katie Peay, 709 Arch St., Norristown, PA (US) 19404

( * ) Notice: Subject to any disclaimer, the term of this patent is extended or adjusted under 35 U.S.C. 154(b) by 0 days.

(21) Appl. No.: 11/210,375

(22) Filed: Aug. 24, 2005

(65) Prior Publication Data

US 2006/0089081 A1 Apr. 27, 2006

Related U.S. Application Data

(60) Provisional application No. 60/622,078, filed on Oct. 26, 2004.

(51) Int. Cl.
*A41C 3/00* (2006.01)

(52) U.S. Cl. ..... 450/31; 2/16; 2/59

(58) Field of Classification Search ..... 450/30–35; 2/53–56, 59, 16, 105, 106, 104, 114, 113, 2/115, 73; 602/20, 4, 62, 63; 128/877, 874, 128/878, 881

See application file for complete search history.

(56) References Cited

U.S. PATENT DOCUMENTS 4,016,027 A 4/1977 Kintanar
4,229,833 A * 10/1980 Cox et al. ..... 2/16
4,625,338 A * 12/1986 Starling ..... 2/106
5,357,633 A * 10/1994 Rael ..... 2/16
5,592,953 A 1/1997 Delao
5,974,586 A * 11/1999 Reinoso ..... 2/16
6,000,993 A 12/1999 Erwin
6,052,824 A * 4/2000 May ..... 2/16
6,138,276 A 10/2000 Asciutto et al.
6,146,239 A * 11/2000 Magliocchetti ..... 450/1
6,183,339 B1 2/2001 Thompson
6,223,565 B1 * 5/2001 Cooper ..... 66/172 E
D449,422 S 10/2001 Massie
6,393,611 B1 5/2002 Thompson

OTHER PUBLICATIONS

Gershamn, M.D., Maurice; Journal of the American Medical Association, vol. 68, No. 7, p. 930.*

* cited by examiner

*Primary Examiner*—Gloria M. Hale
(74) *Attorney, Agent, or Firm*—Caesar, Rivise, Bernstein, Cohen & Pokotilow, Ltd.

(57) ABSTRACT

An undergarment for shaping (slimming) the upper arm of a woman. The undergarment is used in combination with a bra having a shoulder strap and is in the form of a sleeve of an elastic material, e.g., Lycra® or Spandex®, through which the arm of the woman is extended. The sleeve extends from near the elbow of the woman to a point adjacent her shoulder. The sleeve also includes an elongated extension projecting away from the sleeve. The extension has a free end portion adapted to be releasably secured, e.g., looped about, to the shoulder strap of the bra.

12 Claims, 1 Drawing Sheet

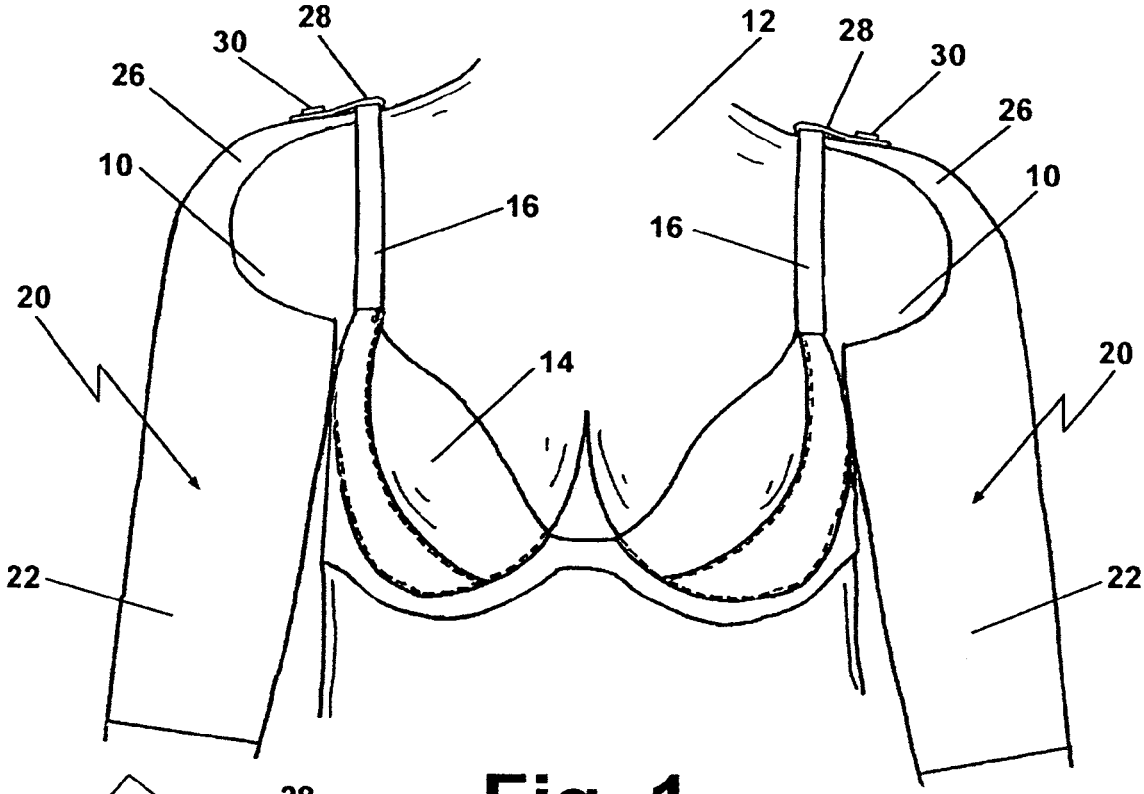
Fig. 1
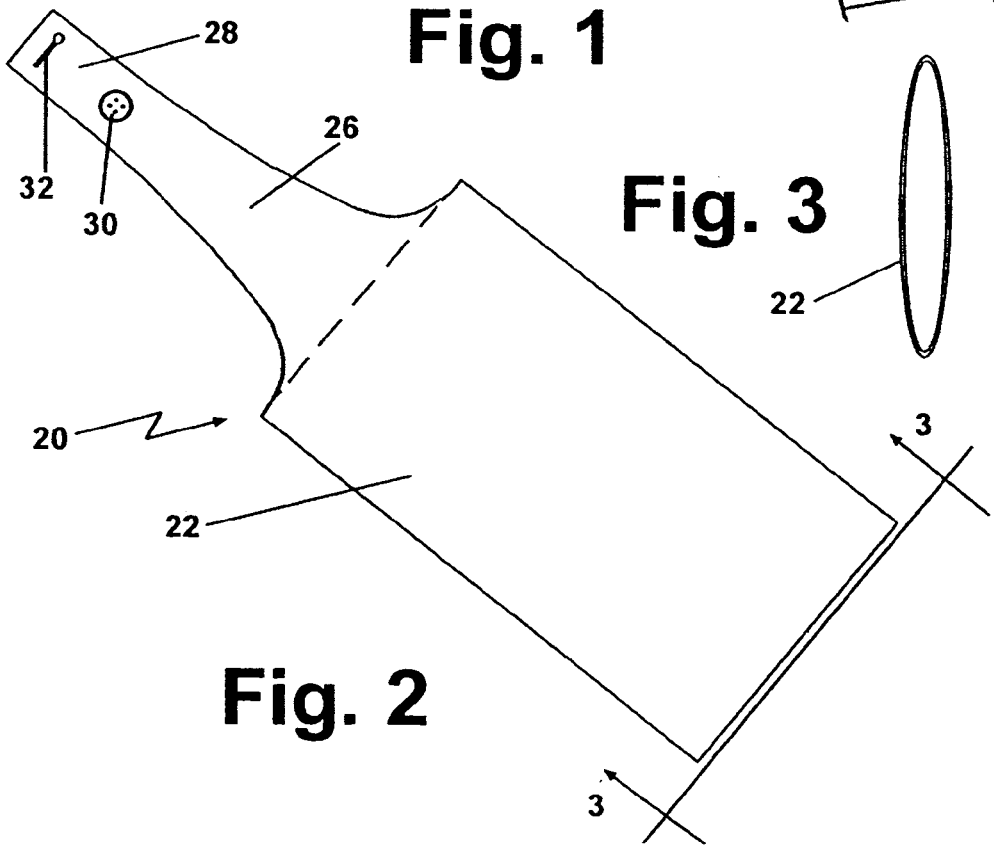
Fig. 2
Fig. 3

UNDERGARMENT FOR BODY SHAPING

CROSS-REFERENCE TO RELATED APPLICATIONS

This application claims priority from provisional U.S. Patent Application No. 60/622,078, filed on Oct. 26, 2004.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

1. Field of Invention

This invention relates generally to undergarments, and more particularly to an undergarment for securement to the strap of a brassiere for shaping the upper arm of a woman to provide a more slender appearance therefor.

2. Description of Related Art

Many women have somewhat heavy and/or flabby upper arms, which they consider unsightly. Accordingly, such women frequently wear outer garments to conceal their upper arms. While this may be suitable for some situations, if the outer garment's sleeves are somewhat tight fitting, concealment may not be as effective as if the sleeve of the outer garment was loose-fitting.

In U.S. Pat. No. 4,625,338 (Starling) there is disclosed a ladies' garment arranged for smoothing the wrinkles and flabbiness in the skin and muscles of the forearm and upper arm to improve appearance, primarily when wearing sleeveless dresses and blouses. The garment is made of a two-way resilient stretchable sheer fabric, and consists of a waist encircling portion connected to a pair of spaced extending arm portions. The arm portions can extend to the wrist and hidden from view by wearing of a bracelet or the like. The wrist portion can be provided with separable segments for adjusting the length. The other end of the arm portions extend to the shoulders for applying a tension to maintain the arm portions in position. The garment is designed as to not be visible from the front or rear of the wearer.

In U.S. Pat. No. 4,016,027 (Kintanar) there is disclosed a pair of cosmetic gloves formed from sheer and elastomeric yarn, which when worn smooth and firm wrinkled skin which is exposed to view. The gloves have hand and arm-receiving portions which can be connected. Overlapping straps are also provided on the back of the arm-receiving portions which are adjustably connected to vary the tension applied by the gloves to the skin.

U.S. Pat. No. 6,393,611 (Thompson) and U.S. Pat. No. 6,183,339 (Thompson) there are disclosed a women's sleeved under/outer garments for fitting snugly over conventional brassieres (or other undergarments) and for concealing or covering a wearer's arms without adding undue bulkiness about the torso of the wearer. The sleeved under/outer garments may be used to conceal any flabbiness, wrinkles, or age spots that may exist on the arm of the wearer without adding undue bulkiness about the torso of the wearer.

In U.S. Pat. No. 6,000,993 (Erwin) there is disclosed a lady's undergarment which has a front neck hole seam that is generally W-shaped and has a raised middle section which falls in between the user's breasts. The undergarment has a lower opening that is defined by a generally straight back hem and a bevel front hem which has a lowermost portion that is cut at an angle. The undergarment may include one strap or two straps or be strapless. A collar may be attached to the undergarment. The back hem of the lower opening of the undergarment may be sufficiently long to be passed between the legs of the user and extended upwards to be attached to the undergarment. The undergarment may include cushioning means at several different sections of the undergarment. Undergarments that are designed for women who are missing one or both breasts may have cushioning to line area where breast is missing. The undergarment may include a flap between the folds of the breasts. A basically triangular patch may be attached to the vicinity of and is designed to closely silhouette the front neck hole seam. Finally, the undergarment may be combined with and attached to a brassiere to be worn by the user as one unit. The undergarment may be attached to and may include a girdle. The girdle may be combined with and attached to the undergarment as a padding or as an extension of the undergarment. If attached to the undergarment as an extension, the girdle may form legs for the undergarment or may form openings for passage of legs of user into and out of the undergarment.

In U.S. Pat. No. 5,592,953 (Delao) there is disclosed a protective sleeve for protectively covering an appendage and medicinal sites such as intravenous equipment, bandages, wounds, etc. The sleeve is open at both ends with adjustable elastic sections which effectively seal the sleeve against the appendage. The elastic sections are equipped with elastic drawstrings which circumscribe a cushioning resilient layer. When the drawstrings are drawn and tied together the elastic force of the drawstring applies a sealing force to the resilient layer causing the layer to conform to the appendage configuration and seal the elastic section against the appendage. The drawstrings may be untied to release the contractive force so as to permit the sleeve to be removed from the appendage.

In U.S. Design Letters Pat. No. D449,422 (Massie) there is disclosed a design for a pair of sleeves with integral mittens at the end of each sleeve. The two sleeves with their integral mittens are arranged to be secured together by fastening strips.

In U.S. Pat. No. 6,146,239 (Magliocchetti) there is disclosed a band for connecting a bra strap to a sleeve of a garment. In U.S. Pat. No. 6,138,276 (Ascuitto et al.) there is disclosed a device for securing a pad to the strap of a bra.

While the devices of the foregoing patents appear generally suitable for their intended purposes, they never the less leave much to be desired from the standpoints of aesthetic appearance (e.g., concealability), simplicity of construction, low cost and wearing comfort.

The subject invention is designed to address those needs by providing an undergarment which is arranged to be readily placed on the woman's upper arm and releasably connected to her bra to the upper arm and thereby resulting in a slimmer, smoother, tighter, more firm-looking appearance.

BRIEF SUMMARY OF THE INVENTION

A undergarment for use in shaping the upper arm of a woman to provide a slimmer appearance for the woman's upper arm. In accordance with one aspect of this invention the undergarment is in the form of a sleeve arranged to be used in combination with a bra having a shoulder strap. In accordance with another aspect of this invention the undergarment comprises the combination of the sleeve and a bra having a should strap.

Thus in accordance with the first aspect of this invention the sleeve has a longitudinal axis and is formed of an elastic material, e.g., Lycra® or Spandex® or any other suitably elastic, yet comfortable-to-wear material, through which the arm of the woman is extended. The sleeve is of a sufficient length measured along the longitudinal axis to extend from near the elbow of the woman to a point adjacent the shoulder of the woman. The undergarment includes an elongated extension projecting away from the sleeve in a direction parallel to the longitudinal axis. The extension has a free end portion adapted to be releasably secured to the shoulder strap of the bra.

In accordance with the other aspect of this invention the sleeve and the bra together comprise the undergarment, with the sleeve having the same construction as set forth above and with the bra having a strap to which the sleeve is releasably secured.

BRIEF DESCRIPTION OF SEVERAL VIEWS OF THE DRAWINGS

The invention will be described in conjunction with the following drawings in which like reference numerals designate like elements and wherein:

FIG. 1 is front elevation view of a woman wearing two undergarments of the subject invention, one on each arm;

FIG. 2 is a top plan view of each of the undergarments shown FIG. 1; and FIG. 3 is an end view taken along line 3—3 of FIG. 2.

DETAILED DESCRIPTION OF THE INVENTION

Referring now to the various figures of the drawing wherein like reference characters refer to like parts, there is shown in FIG. 1 two control undergarments 20 constructed in accordance with one exemplary embodiment of this invention. Each of the undergarments 20 is arranged for disposition on a respective upper arm 10 of the woman 12 to shaping the upper arm and thereby provide a slimmer appearance.

Each undergarment 20 is arranged to be used in combination with the bra 14 that the woman wears. That bra is shown in FIG. 1, and can be of any type, providing it includes a pair of shoulder straps 16 having a shoulder strap. The undergarment comprising a sleeve 22 having a longitudinal axis 24. The sleeve is formed of any suitable elastic or elastomeric material, that is preferably sheer. Examples of such materials are Lycra®, Spandex®, etc., or any other material that stretches and naturally attempts to return to its un-stretched condition and which is comfortable to wear, e.g, breathable, etc. The yarn can be opaque or substantially transparent.

As best seen in FIG. 3 the sleeve is a tubular member, through which a respective arm 10 of the woman is extended.

As best seen in FIG. 1 the sleeve is of a sufficient length measured along the longitudinal axis 24 to extend from near the elbow of the woman to a point adjacent the shoulder of the woman.

As best seen in FIG. 2 the undergarment 20 including an elongated extension 26 projecting away from said sleeve 22 in a direction parallel to the longitudinal axis 24. The extension 26 has a free end portion 28 adapted to be releasably secured to the associated shoulder strap 16 of the bra 14. In accordance with one preferred aspect of this invention the free end portion 28 extension 26 includes a releasably securable connector that enables the free end portion to be looped about the bra's shoulder strap and connected to itself. In particular, in the exemplary embodiment shown in FIGS. 1 and 2, the releasably securable connector comprises at least one button 30 and at least one button hole 32. With such an arrangement the free end portion of the extension can be placed under the shoulder strap and folded over itself to form a loop so that the button can be extended through the adjacent button hole. This action releasably traps the shoulder strap in the loop.

It should be pointed out at this juncture other releasable fastening means can be used in place of the button and button hole, e.g., snap-connectors, VELCRO® connectors, etc.

As should be appreciated by those skilled in the art when the undergarment of the subject invention is placed on the upper arm of the wearer, the elastomeric nature of the fabric making up the sleeve will apply tension to the skin to smooth and firm any loose skin or wrinkles. The amount of tension applied to the skin by the undergarments of this inventoin can be tailored to the individual by proper selection of the type and dernier of elastomeric fibers making up the sleeve's fabric and/or by appropriate sizing of the sleeve. Moreover, inasmuch as each of the sleeves is arranged to be releasably secured to an associated bra strap, the sleeves will be retained in position against slippage, migration downward or a tendency to bunch or roll up, all of which could adversely affect their desired body shaping (slimming) function. Since each sleeve includes the elongated projection and the releasable fastening means the sleeves of this invention can be used with any conventional bra, without any modification of the bra's straps. Moreover, specially configured bras are not required. A further advantage of the undergarments of this invention is the fact that the not only serve to shape the arm so that to provide a smooth, unwrinkled and slimmer appearance, but also will serve to protect the arm of the wearer from moisture and cold.

Without further elaboration the foregoing will so fully illustrate my invention that others, made by applying current or future knowledge, readily adapt the same for use under various conditions of service.

What is claimed is:

1. A control undergarment for use in shaping the upper arm of a woman to provide a slimmer appearance for the woman's upper arm, said undergarment being arranged to be releasably secured to the shoulder strap of a bra, said undergarment comprising a sleeve comprising a generally tubular body having a first open end, a second open end, a longitudinal axis and being formed of an elastic material through which the arm of the woman may be extended so that said first open end is located closely adjacent the elbow of the woman and said second open end is located closely adjacent the armpit of the woman but not reaching the shoulder of the woman, said sleeve being dimensioned to constrict the portion of the arm of the woman extending through said tubular body, said sleeve including an elongated, strip-like extension projecting away from said tubular body in a direction parallel to said longitudinal axis, said strip-like extension having a free end portion adapted to be extended over the shoulder of the woman to engage and be releasably secured to the shoulder strap of the bra.

2. The undergarment of claim 1 where said sleeve is formed of spandex.

3. The undergarment of claim 1 wherein said strip-like extension includes releasably securable fastening means and wherein said extension is arranged to be looped about a portion of the shoulder strap and releasably secured to itself by said releasably securable fastening means to thereby releasably secure said strip-like extension to the bra strap.

4. The undergarment of claim 3 wherein said strip-like extension includes releasably securable fastening means comprises at least one button and at least one button hole.

5. The undergarment of claim 3 wherein said releasably securable fastening means comprises a snap connector.

6. The undergarment of claim 3 wherein said releasably securable fastening means comprises a pair of cooperating hook and loop fasteners.

7. A control undergarment for use in shaping the upper arm of a woman to provide a slimmer appearance for the woman's upper arm, said undergarment comprising the combination of a sleeve and a bra, said bra having a shoulder strap, said sleeve being a generally tubular body having a first open end, a second open end, a longitudinal axis and being formed of an elastic material through which the arm of the woman may be extended so that said first open end is located closely adjacent the elbow of the woman and said second open end is located closely adjacent the armpit of the woman but not reaching the shoulder of the woman, said sleeve being dimensioned to constrict the portion of the arm of the woman extending through said tubular body, said sleeve including an elongated, strip-like extension projecting away from said tubular body in a direction parallel to said longitudinal axis, said strip-like extension having a free end portion, said free end portion being releasably secured to said shoulder strap of said bra.

8. The undergarment of claim 7 where said sleeve is formed of spandex.

9. The undergarment of claim 7 wherein said strip-like extension includes releasably securable fastening means for releasably securing said sleeve to said strap and wherein said extension is arranged to be looped about a portion of said shoulder strap and releasably secured to itself.

10. The undergarment of claim 9 wherein said releasably securable fastening means comprises at least one button and at least one button hole.

11. The undergarment of claim 9 wherein said releasably securable fastening means comprises a snap connector.

12. The undergarment of claim 9 wherein said releasably securable fastening means comprises a pair of cooperating hook and loop fasteners.

* * * * *